US005782545A

United States Patent [19]

Kahara et al.

[11] Patent Number: 5,782,545

[45] Date of Patent: Jul. 21, 1998

[54] MULTIPLE DRAWER INTERLOCKING SYSTEM

[75] Inventors: Thomas Arthur Kahara, Fitchburg; Wayne Rodriques Crespo, Winchendon, both of Mass.

[73] Assignee: ESP Lock Products, Inc., Leominster, Mass.

[21] Appl. No.: 820,863

[22] Filed: Mar. 20, 1997

[51] Int. Cl.[6] ..... E05B 65/46

[52] U.S. Cl. ..... 312/217; 312/221

[58] Field of Search ..... 312/217, 219, 312/221, 216

[56] References Cited

U.S. PATENT DOCUMENTS

| | | | |
|---|---|---|---|
| 4,957,334 | 9/1990 | Lakso | 312/219 X |
| 4,993,784 | 2/1991 | Dana et al. | 312/221 |
| 5,303,994 | 4/1994 | Elsholz | 312/221 |
| 5,352,030 | 10/1994 | Derle et al. | 312/221 |

*Primary Examiner*—Peter M. Cuomo
*Assistant Examiner*—Janet M. Wilkens
*Attorney, Agent, or Firm*—Iandiorio & Teska

[57] ABSTRACT

A multiple drawer interlocking system includes a plurality of the elongate locking elements; the track for confining the locking elements in string; biasing means for urging the locking elements into a contiguous series with each adjacent pair meeting at a junction; and the plurality of actuator devices each having a first unlocked state and a second locked state; each actuator device including an actuator element and a pair of opposing camming elements engaged with the adjacent ends of a pair of locking elements at a junction; each actuator element in the unlocked state being poised adjacent a junction of the string and in its second locked state being introduced into the associated junction between a pair of the locking elements to drive apart the camming elements and the associated locking elements against the urging of the biasing means to misalign all of the remaining junctions with respect to the remaining actuator devices and prevent the remaining actuator devices from moving into the locked state.

5 Claims, 4 Drawing Sheets

MULTIPLE DRAWER INTERLOCKING SYSTEM

FIELD OF INVENTION

This invention relates to a multiple drawer interlocking system and more particularly to such a system which requires a minimum of locking elements.

BACKGROUND OF INVENTION

In multiple drawer interlocking systems only one drawer of a filing cabinet, for example, can be pulled out at a time. In one conventional approach a number of small discrete locking elements are confined in a string in a track. Biasing springs at both ends of the track keep the elements contiguous with adjacent ones meeting at a junction. There are a plurality of actuator devices, one associated with each drawer, and poised at a junction. When a drawer is pulled out the actuator interjects between a pair of elements driving them apart and shifting all the other elements so no other actuator aligns then with a junction and no other drawer can be pulled out. One problem with this approach is that these elements are small, typically on the order of a half inch or so, so that a large number of such elements is required for a system. These elements are expensive and large numbers of them make handling and assembly difficult. Further, the elements must be made with precision. Even so, deviations in length even within tolerance can cause accumulated error to produce misalignment problems with the actuators of multiple drawers. In some constructions the elements are in the shape of elongate cylinders and the actuator uses a ball to interject at the junction. In such situations even a slight lateral misalignment of the ball with respect to the longitudinal center line of the elements and track can increase the amount of travel required of the ball to actuate or spread the elements at the junction sufficiently to block the other actuators from operating.

SUMMARY OF INVENTION

It is therefore an object of this invention to provide an improved multiple drawer interlocking system.

It is a further object of this invention to provide said an interlocking system in which the number of locking elements is minimized.

It is a further object of this invention to provide said an interlocking system in which the locking elements are inexpensive, simple and easy to make and install.

It is a further object of this invention to provide said an interlocking system in which the effect of cumulative tolerance errors is virtually eliminated.

It is a further object of this invention to provide said an interlocking system in which lateral misalignment errors between the actuator and locking elements has virtually no effect on the travel requirement to properly lock out all of the actuators.

This invention results from the realization that a simpler, more effective multiple drawer interlocking system can be achieved using a plurality of locking elements biased into a string in a track so that adjacent locking elements meet at junctions and each actuator device includes an actuator element and a pair of opposing camming elements which are spread apart by the actuator element when an actuator device is operated from the first unlocked state to a second locked state thereby shifting the junctions aligned with each of the other actuator devices so they cannot be operated to the locked state and their drawers cannot be pulled open.

This invention features a multiple drawer interlocking system including a plurality of elongate locking elements, a track for confining the locking elements in a string and biasing means for urging the locking elements into a contiguous series with each adjacent pair meeting at a junction. There is a plurality of actuator devices each having a first unlocked state and a second locked state. Each actuator device includes an actuator element and a pair of opposing camming elements engaged with the adjacent ends of a pair of locking elements at a junction. Each actuator element in the unlocked state being poised adjacent a junction of the string and in its second locked state being introduced into the associated junction between a pair of the locking elements to drive apart the camming elements and the associated locking elements against the urging of the biasing means to misalign all of the remaining junctions with respect to the remaining actuator devices and prevent the remaining actuator devices from moving into the locked state.

In a preferred embodiment each of the locking elements may include a notch at its junction with an adjacent locking element. Each of the camming elements may include a coming surface for engaging the actuator element, a driver for engaging the notch of the associated locking element, and a retainer member for arresting motion of the actuator element when the associated actuator device is misaligned with its junction.

DISCLOSURE OF PREFERRED EMBODIMENT

Other object, features and advantages will occur from the following description of a preferred embodiment and the accompanying drawings, in which.

Figure 1:
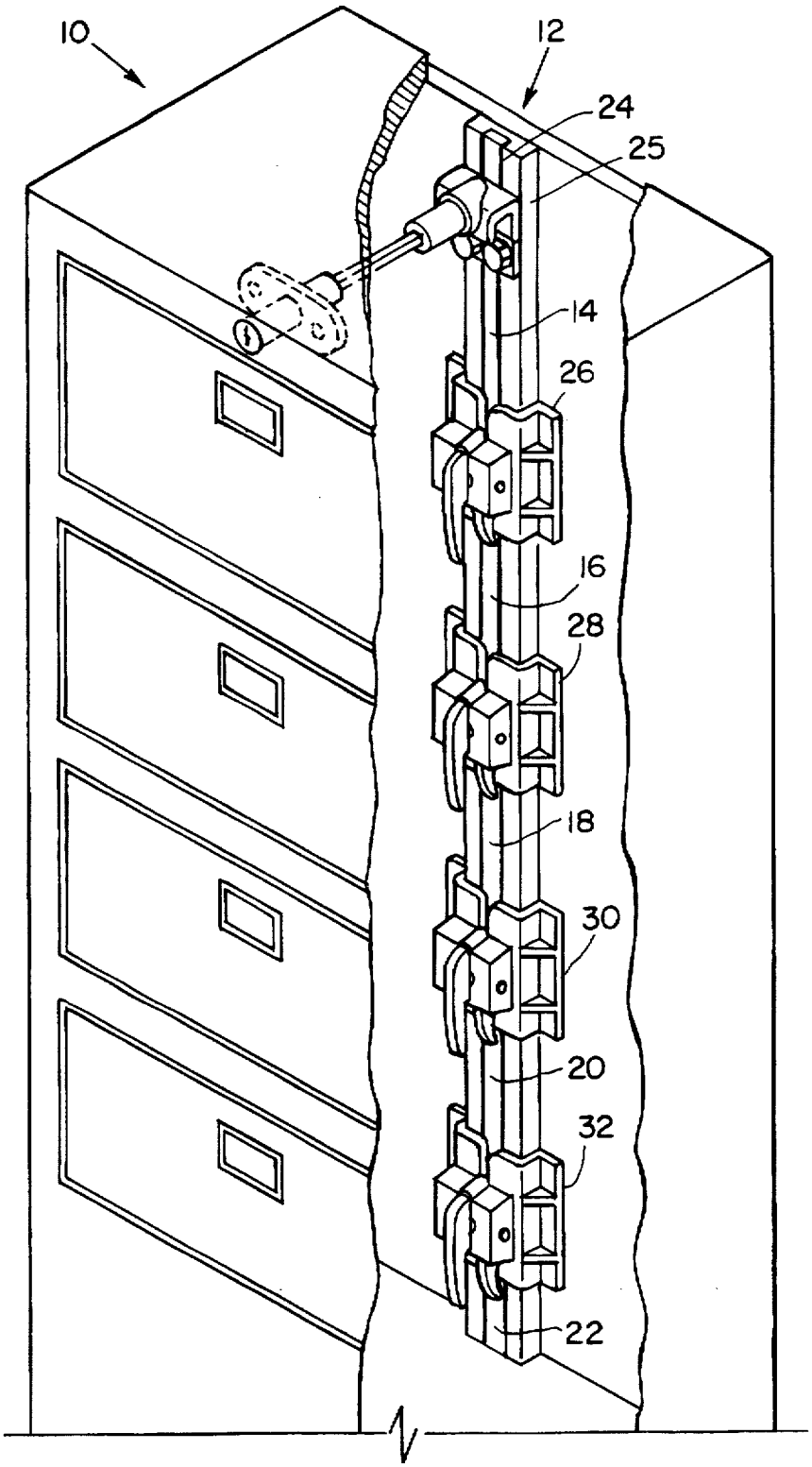
FIG. 1 is a three dimensional diagrammatic view of a multi-drawer cabinet including a multi-drawer interlocking system according to this invention.

There is shown in FIG. 1 a multiple drawer cabinet 10 including a multiple drawer interlocking system 12 according to this invention. Multiple drawer interlocking system 12 includes a plurality of locking elements 14, 16, 18, and 20, extending in confined groove 24 of track 25. Locking elements 14–20, meet at junctions covered by actuator devices 26, 28, 30 and 32.

Figure 1A:
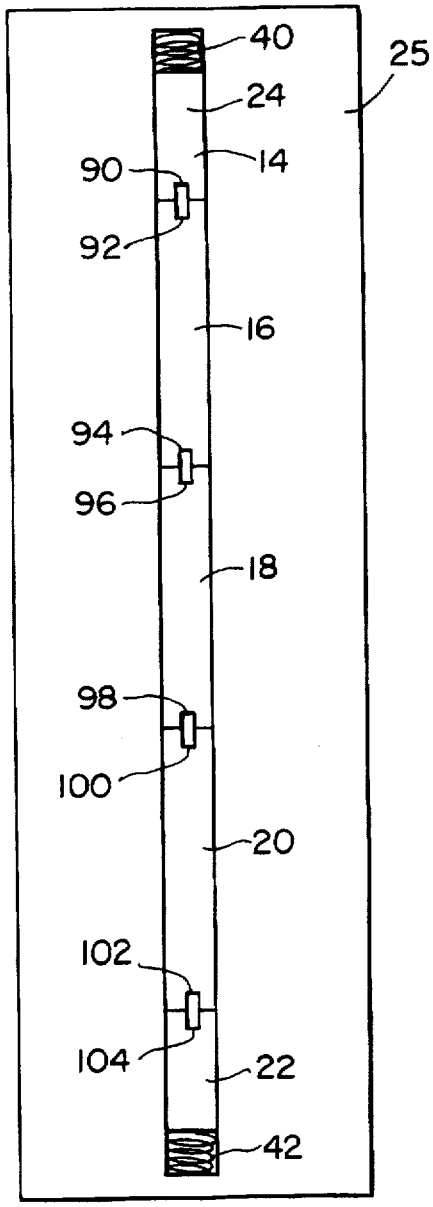
FIG. 1A is a front elevational view of the track and locking elements with the locking elements removed.
Figure 3A:
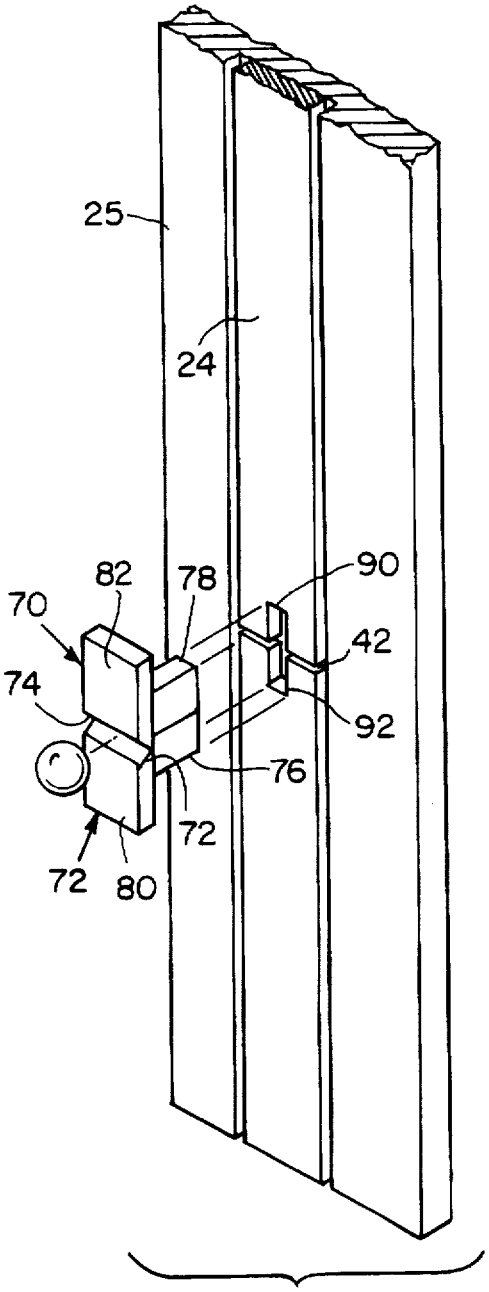
FIG. 3A is a three dimensional diagrammatic view of the track illustrating the junction of two locking elements and the cooperating camming elements.
Figure 4:
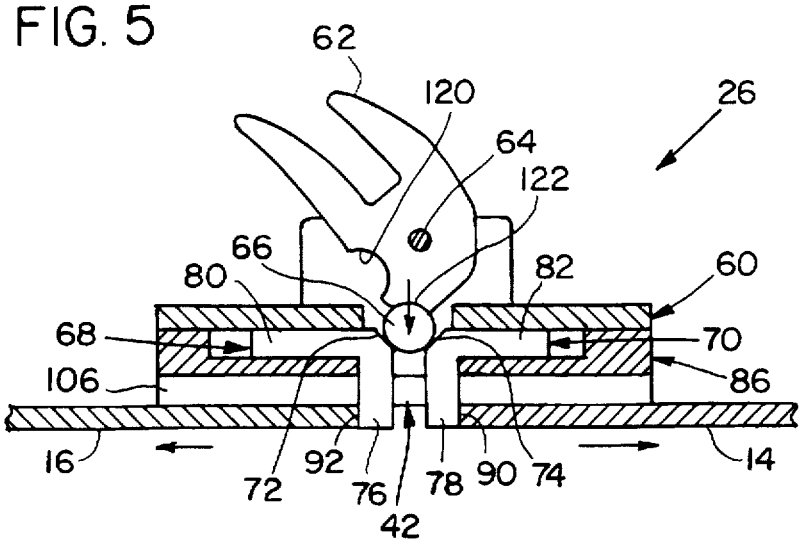
FIG. 4 is a view similar to FIG. 3 with the actuator device in the locked state.

Locking elements 14–22, FIG. 1A, are held in a contiguous string by means of biasing springs 40 and 41 so that adjacent pairs of locking elements form junctions 42, 44, 46, and 48 where they meet. It is at these junctions that actuator devices 26–32 operate to lock and unlock the drawers. When its desired to lock all the drawers, lock mechanism 50 may be rotated 90° or 180° so that none of the junctions 42–48 are aligned with any of the actuator elements 26–32. Lock mechanism 50 may be maintained in the unlocked condition wherein any one of the drawers can be withdrawn, but once having been withdrawn prevents all other drawers from being withdrawn at the same time. The operation of the interlocking system which allows one and only one drawer to be withdrawn at a time is fully explained in U.S. Pat. No. 4,993,784, fully incorporated herein by reference, especially with respect to FIGS. 3A and 3B, and it is well known in the art. The locking technique whereby all the drawers may be locked with a lock mechanism, such as lock mechanism 50, is also shown in that patent, particularly with respect to FIGS. 4A and 4B. Many other techniques are available and are well known in the prior art.

Figure 2:
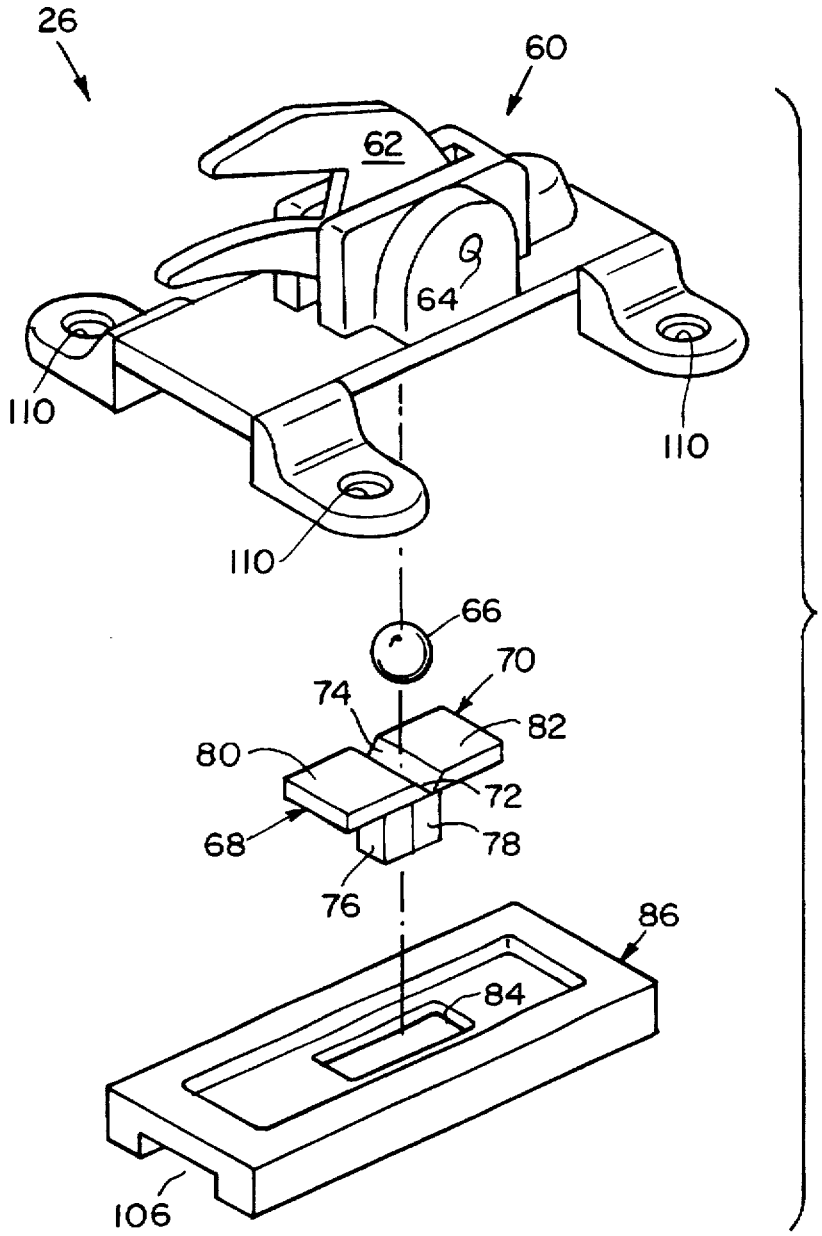
FIG. 2 is a three dimensional exploded diagrammatic view of an actuator device according to this invention.

According to this invention each actuator 26–32 is constructed as shown with respect to actuator 26, FIG. 2. There is a top portion 60 which includes an operator 62 that rotates about pin 64. An actuator element such as ball 66 is aligned with the junction between camming elements 68 and 70 so as to allow ball 66 to be introduced between them pushing them apart or to allow ball 66 to be withdrawn allowing them to come together as they are shown in FIG. 2. Camming element 70 may include camming surfaces 72 and 74, driver members 76 and 78, and retainer members 80 and 82. Driver members 76 and 78 extend to slot 84 in base 86 of actuator device 26 to engage with the notches 90 and 92 at junction 42. Each of the junctions 44–48 may also have notches 94, 96, 98, 100, 102, 104 although other means may be used to interconnect camming elements 68 and 70 and their respective locking elements. Groove 106, FIG. 2, is provided at the bottom of base 86 to embrace track 25. Top portion 60 has four holes 110 only three of which are visible in top portion 60 of actuator device 26, FIG. 2, for mounting to track 25.

Figure 3:
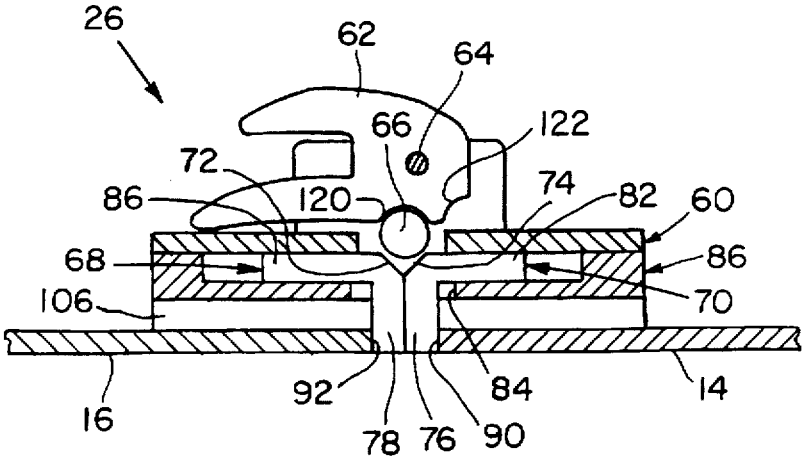
FIG. 3 is a diagrammatic cross sectional side elevational view of an actuator device in the unlocked state installed on the track.
Figure 5:
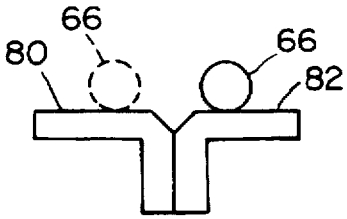
FIG. 5 is a side elevational view of the retaining members of FIGS. 3 and 4 with the ball in the locking position.

In operation when locking mechanism 50 is in the unlocked position each actuator has its operator 62 in the position as shown in FIG. 3, wherein the actuator element or ball 66 is poised above junction 42 engaging lightly with camming surfaces 72 and 74 of camming elements 68 and 70. Driver members 76 and 78 are engaged with notches 90 and 92 of locking elements 14 and 16. The cooperation between camming elements 68 and 70 and notches 90 and 92 at junction 42, of locking elements 14 and 16, can better be seen in 3A. When a drawer is withdrawn operator 62 of actuator 26, FIG. 4, rotates around pin 64 replacing recess 120, FIG. 3, with recess 122, FIG. 4. Thereby pushing ball 66 down between camming surfaces 72 and 74 spreading apart camming elements 68 and 70 and through their respective drive members 76 and 78 pushing apart locking elements 14 and 16 so that the ball 66 associated with each of the other actuators will be misaligned with its respective junction and no other drawers can be withdrawn. If lock mechanism 50 is in a locked position then all of the balls will be misaligned with their respective junctions, even ball 66 of actuator 26, in FIG. 3 and 4, and so no drawers will be able to be opened. When such a shift has occurred either because lock 50 has locked all of the drawers or because one drawer has been withdrawn locking all of the remaining from being withdrawn, the ball of each representative ball 66, FIG. 5, will rest on retaining member 82 or retaining member 80 until the lock is operated or the open drawer is returned, then all of the balls will align up with their respective junctions and any drawer can be opened.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A multiple drawer interlocking system comprising:

a plurality of elongate locking elements;

a track confining said locking elements in a string;

biasing means for urging said locking elements into a contiguous series with each adjacent pair meeting at a junction; and a plurality of actuator devices each having a first unlocked state and a second locked state; each actuator device including an actuator element and a pair of opposing camming elements engaged with the adjacent ends of a pair of said locking elements at a junction; each actuator element in the unlocked state being poised adjacent a junction of said string and in its second, locked state being interjected into the associated junction between a pair of said locking elements to drive apart said camming elements and the associated locking elements against the urging of said biasing means to misalign all of the remaining junctions with respect to the remaining actuator devices and prevent said remaining actuator devices from moving into the locked state.

2. The multiple drawer interlocking system of claim 1 in which each of said locking elements includes a notch at its junction with an adjacent said locking element.

3. The multiple drawer interlocking system of claim 2 in which each of said camming elements includes a camming surface for engaging the associated said actuator element.

4. The multiple drawer interlocking system of claim 2 in which each of said camming elements includes a driver for engaging the notch of the associated said locking element.

5. The multiple drawer interlocking system of claim 2 in which each of said camming elements includes a retainer member for arresting motion of the associated said actuator element when the associated said actuator device is misaligned with its said junction.

* * * * *